US006200060B1

(12) United States Patent
Vernay

(10) Patent No.: US 6,200,060 B1
(45) Date of Patent: Mar. 13, 2001

(54) DOME TENT POLE CONNECTOR

(75) Inventor: Jacques Vernay, La Fouillouse (FR)

(73) Assignee: Manufacture Stephanoise de Transformations Textiles M.S.T.T. (SA Counseil d'Administration), Etienne (FR)

( * ) Notice: Subject to any disclaimer, the term of this patent is extended or adjusted under 35 U.S.C. 154(b) by 0 days.

(21) Appl. No.: 09/108,721

(22) Filed: Jul. 1, 1998

(30) Foreign Application Priority Data

Jul. 4, 1997 (FR) ..... 97 08759
Oct. 30, 1997 (FR) ..... 97 13883

(51) Int. Cl.[7] ..... E04H 15/36

(52) U.S. Cl. ..... 403/151; 403/101; 403/150; 52/656.9; 135/120.3; 135/114; 135/121

(58) Field of Search ..... 403/150, 151, 403/157, 102, 116, 100, 101, 99, 349; 52/656.9; 135/120.3, 114, 121

(56) References Cited

U.S. PATENT DOCUMENTS

| | | | | |
|---|---|---|---|---|
| 2,724,396 | * | 11/1955 | Pereira | 403/102 X |
| 3,680,448 | * | 8/1972 | Ballingall et al. | 403/102 X |
| 3,795,379 | * | 3/1974 | Gray | 403/99 X |
| 4,365,908 | * | 12/1982 | Thiboutot | 403/102 |
| 5,195,551 | * | 3/1993 | Ju | 403/101 X |

FOREIGN PATENT DOCUMENTS

| | | |
|---|---|---|
| 3631381 | 11/1987 | (DE) . |
| 0 248 540 | 12/1987 | (EP) . |
| 0 507 012 | 10/1992 | (EP) . |
| 0 563 464 | 10/1993 | (EP) . |
| 0 684 355 | 11/1995 | (EP) . |
| 599210 | 3/1948 | (GB) . |

* cited by examiner

*Primary Examiner*—B. Dayoan
*Assistant Examiner*—John R. Cottingham
(74) *Attorney, Agent, or Firm*—Wall Marjama & Bilinski

(57) ABSTRACT

The connector device of the arched poles of a tent is remarkable in that it includes two components (4–5), (9–10) which are able to be coupled into each other in a configuration and connection in the form of a knee permitting a positioning of said components either in a vertical plane or in an extension corresponding to the assembly and placing under tension of the segments of an arch, or by being folded corresponding to a folded position of said segments, and in that a male component (4–9) has on either side of its median portion a part receiving the end of the upper segment and opposite an arm of great length equipped with means permitting its articulation on the second component (5–10) and its locking into position, and in that a female component (5–10) has on either side of a median portion on the one hand means permitting the attachment of a lower segment, and on the other a fork shape (5*b*–10*d*) having a V configuration with inside an oblong port having a V configuration and permitting the positioning, the movement in displacement of the arm of the first component and its pivoting.

12 Claims, 11 Drawing Sheets

4
4a
4e
4c
4c1
4d
4b
4f
4g
3
5e
5f
5c
5b
5b1
5d
5i
5
5a
5h
5g
5g1
6c
6

DOME TENT POLE CONNECTOR

FIELD OF THE INVENTION

The invention concerns the technical field of tent arches and in particular tents forming a dome with incorporated arches.

BACKGROUND OF THE INVENTION

It is known to make arches in the form of hollow segments inside and telescoping one inside another by their ends. To permit a connection between the segments and facilitate their storage, it is common usage to insert, inside the segments near their ends, an elastic means, of assembly and of return, one end of which is fixed to one of the segments and the other to the adjacent segment. By the elasticity of the return means one may very easily define the segments constituting the arch, i.e. fold them back against each other for the purpose of storage or insertion in a storage bag. This simple assembly nevertheless has disadvantages which are inherent to the nature of the materials constituting the arch segments. The latter are either of fiberglass or of aluminum.

Although an arch formed of fiberglass offers certain advantages, especially very competitive manufacturing costs, it has certain disadvantages connected primarily to the fragility of each of these segments since the inside hole creates a rupture focal point and the stresses and strains are substantial. It is moreover necessary to use metal connectors for said segments entailing high assembly costs.

SUMMARY OF THE INVENTION

For arches of aluminum, their advantages are their lightness, their painting or coating, and their good sliding in the sheath of the tent fabric, because no excess thickness allowance or junction appears. The assembly is moreover rapid. The major disadvantage lies essentially in its cost price.

The purpose sought according to the application was to conceive a new device of connection for arch segments among those being able to combine the characteristics and advantages of each of the known techniques while permitting rapid assembly. Another purpose sought according to the invention was to implement a connector device permitting a rapid assembly of the arch segments in camping tents constituted of a cloth of polyamide or polyester or cotton hung on semicircular arches permitting a rapid and immediate placing under tension of the tent during the setup and permitting during the take down a collection of the arch segments without risk of loss.

According to a first characteristic, the connector device is remarkable in that it includes two components which are capable of being coupled one into the other in a configuration and connection in the form of a knee permitting a positioning of said components either in a vertical plane or in an extension corresponding to the assembly and placing under tension of the arch segments, or in being folded together corresponding to a folded up position of said segments, and in that a male component has on either side of its middle portion a part receiving the end of the upper segment and opposite, an arm of great length fitted with means permitting its articulation on the second component and its locking into position, and in that a female component has on either side of its middle portion on one hand means permitting the attachment of a lower segment and on the other a fork shape having a V with an oblong port on the inside having a V configuration and permitting the positioning, the movement in displacement of the arm of the first component and its pivoting.

BRIEF DESCRIPTION OF THE DRAWING

These characteristics and still others will be apparent as a result of the description.

To determine the object the invention is illustrated in a way not limited to the figures of the drawings, wherein.

DETAILED DESCRIPTION OF THE INVENTION

Figure 1:
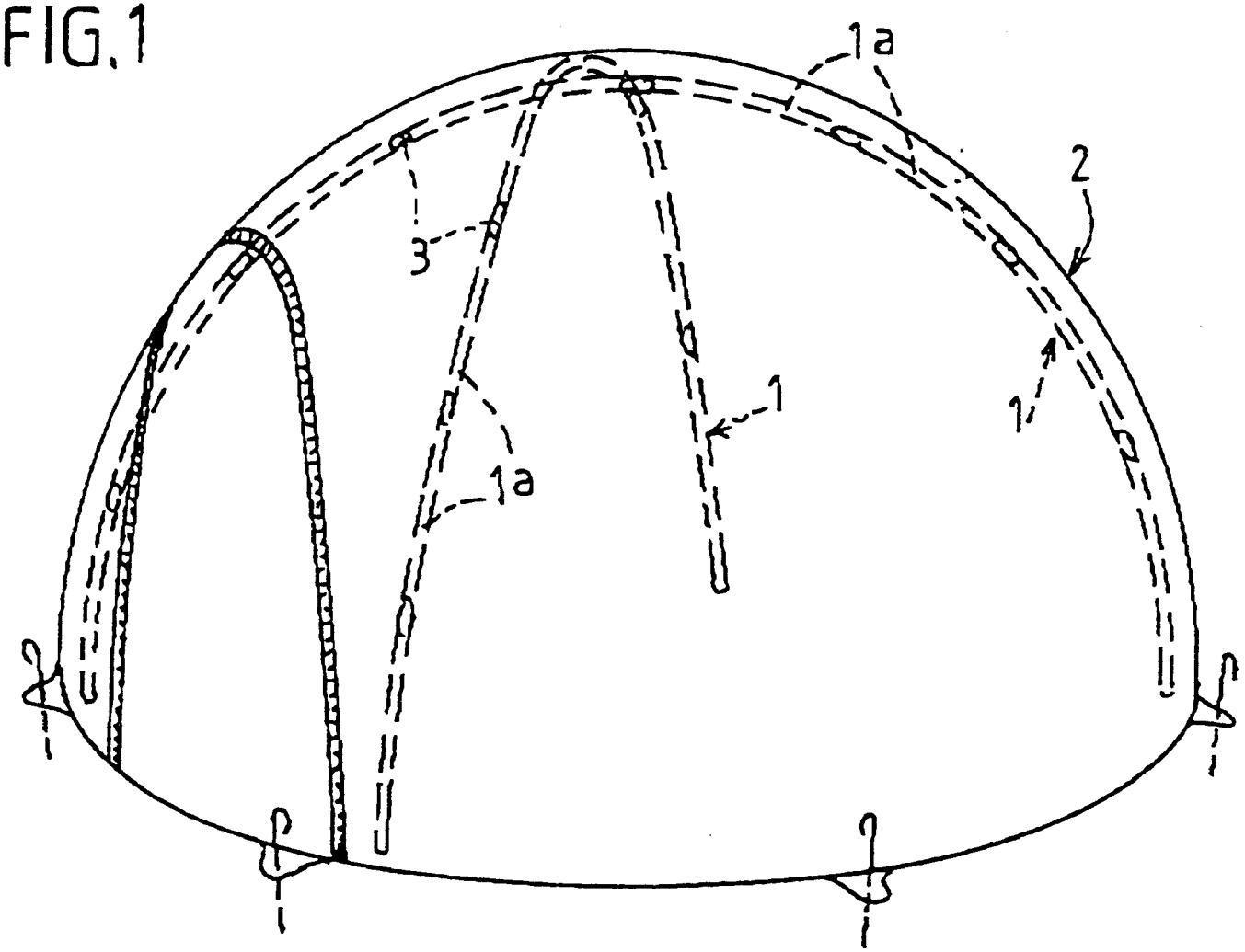
FIG. 1 is a view of a schematic nature illustrating a dome tent including arches according to tie invention, with their connector device.
Figure 2:
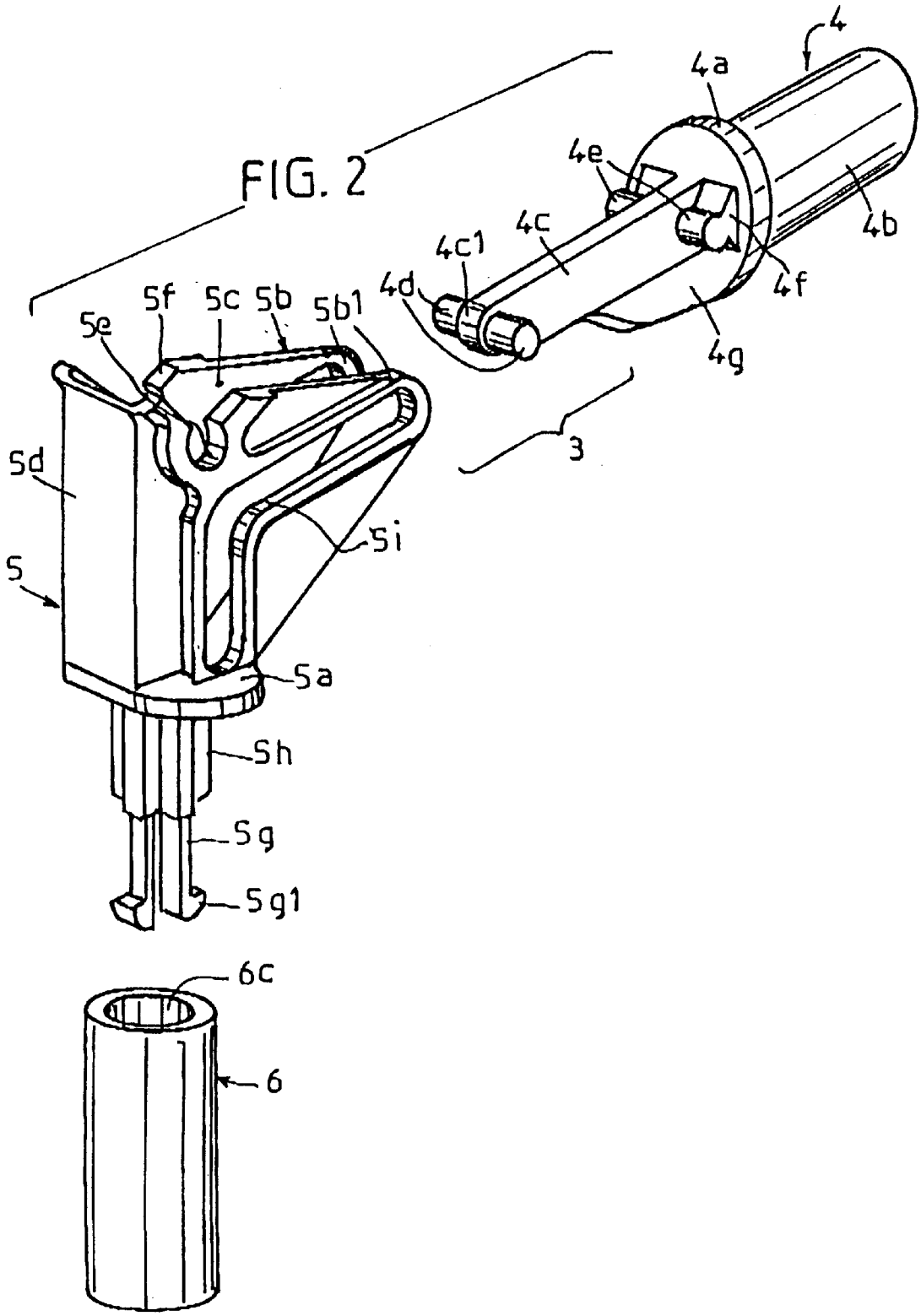
FIG. 2 is a large scale view illustrating the connector device in a first variation of implementation.

In order to render the object of the invention more complete, it is described now in a non-limiting way illustrated in the figures of the drawings.

The arches are referenced in their entirety by (1) and are formed of any structural material, fiberglass or aluminum or other, and have the function of ensuring the placing under tension and development of a tent (2) in the form of an igloo or tunnel for example. These arches (1) include a number of segments **(1*a*) able to be coupled together with the aid of a connector device referenced in its entirety by (3)** while permitting a radial angular orientation of the upper segment relative to the lower segment.

This connector device (3) is formed according to the invention with two components (4–5) which are able to be coupled one in to another while permitting a positioning of said components either in a vertical plane or in extension corresponding to the assembly and placing under tension of the segments of arches, or being folded up corresponding to a folded position of said segments, one (5) of the components receiving a means (6) which is free to rotate permitting adapting the angular orientation of said segments relative to each other.

Said components (4–5) are coupled in a configuration and connection in the form of a knee permitting the aforementioned functions. Both components are formed preferably of synthetic material molded by injection. These components are equipped with particular shapes permitting respectively assembly of the ends of the segments of arches to be joined, their articulation, and their locking into position.

A first component (4) has on its middle portion a disk shape (4*a*) with on the one hand a tubular part (4*b*) which is hollow inside, able to receive the end (1*a*1) of the upper segment (1*a*). On the opposite end, this component (4) has an arm (4*c*) of great length arranged axially in the median longitudinal plane of the component and equipped at its free end (4*c*1) with two fingers (4*d*) in perpendicular projection on the plane of said arm. These fingers (4*d*) have a cylindrical conformation, for example. At the base of said arm are provided two other fingers (4*e*) of similar shape which have the function of ensuring a locking into position on the other component (5). These projecting fingers (4*c*) are slightly offset in front of the center disk with a support platform (4*f*) with oblique surfaces. The lower portion of the arm has the shape of a keel (4*g*) of a ship avoiding a blockage of the two components during unfolding.

The second component (5) of the connector device is equipped and profiled to permit on the one hand the insertion and locking of the first component (4) and the articulation of the latter, and on the other hand to permit the positioning and insertion of a pivot sleeve (6) which can constitute the receiving base of the end (1*a*2) of the next consecutive segment (1*a*) of the arch. More especially, the component (5) includes a base in the shape of a disk (5*a*) prolonged on one side by a profiled shape forming a fork (5*b*) with two cheeks (5*b*1) defining among themselves an interval (5*c*) for the positioning and penetration of the arm (4*c*) of the first component (4). The orientation of said cheeks is established in a V configuration, said cheeks having inside an oblong port (5*i*) along the same profile as said cheeks and thus defining the course of displacement of the arm (4*c*) of the first component. The base (5*d*) of the fork part is situated in the longitudinal axial extension of said component or at an angle of 2 to 5 degrees of said component (FIGS. 3 and 5) with then an oblique orientation according to an angle which can be on the order of 40 to 60 degrees approximately relative to the longitudinal median axis of the component (5). Moreover, there is shaped in the extension of the base a complementary form (5*e*) forming a housing capable of receiving the fingers (4*e*) established on the first component. This form (5*e*) for housing is established in different ways and for example with a neck (5*f*) permitting an attachment by clipping of the first component. The outlet of the housing (5*e*) is established with oblique surfaces able to constitute support surfaces of forms with corresponding and complementary oblique surfaces established on the other component.

Said ports (5*i*) permit the passage and the displacement of the fingers (4*d*) established at the end of the aforementioned arm (4*c*) so as to cause folding together in position the first component.

On the other side of the disk portion, the second component (5) is equipped with tab extension shapes (5*g*) according to a boss (5*h*) or the like which comes overlapping the median disk. The boss and its tabs are able to be engaged in a sleeve or pivot (6). This pivot (6) has inside a collar (6*a*) with an inside grooving (6*b*) permitting the positioning and fixing of the ends forming the fingers (5*g*1) of said tabs. Said collar (6*a*) is situated offset from an inside bore (6*c*) which comes to cover or overlap the boss part (5*h*) of the second component thus permitting rotation of said pivot sleeve (6) relative to the second component (5). Moreover, said pivot sleeve has opposite the first bore another inside chamber (6*d*) which can receive the end (1*a*1) of the segment (1*a*) of the arch. Means of abutment (6*e*) by projection are established in said second chamber to which abuts the end of the segment.

Figure 3:
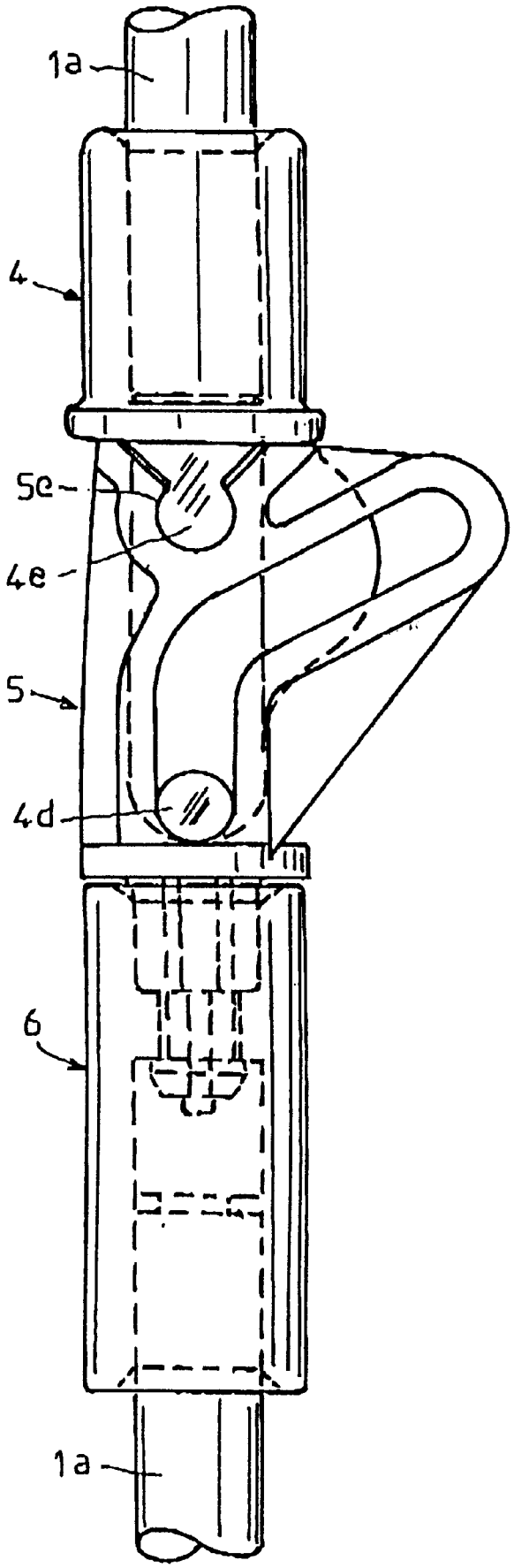
FIG. 3 is a plan view illustrating the connector device after assembly in an assembly position.
Figure 4:
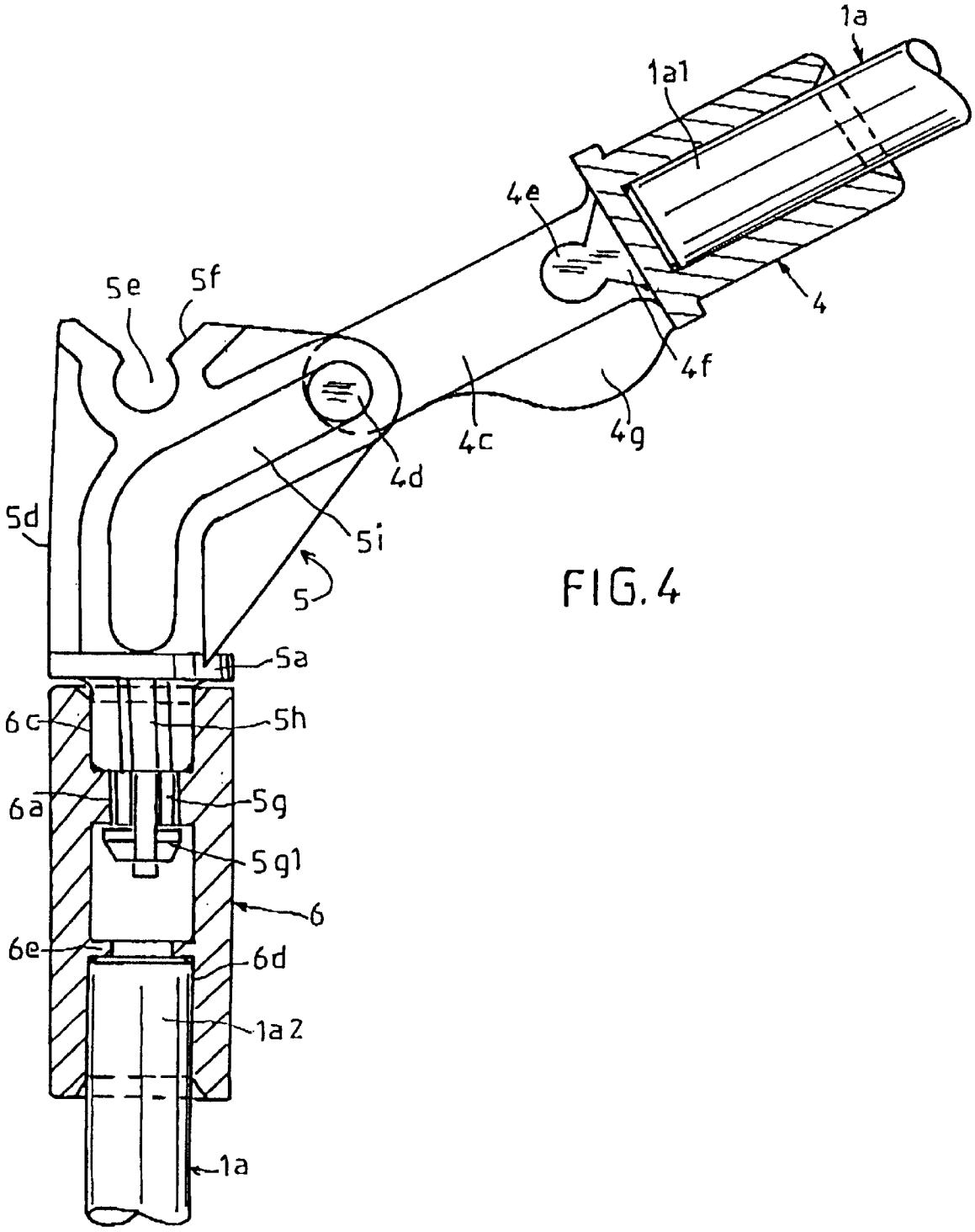
FIG. 4 is a view showing the disengagement of a segment for disassembly of the arch after folding together.
Figure 5:
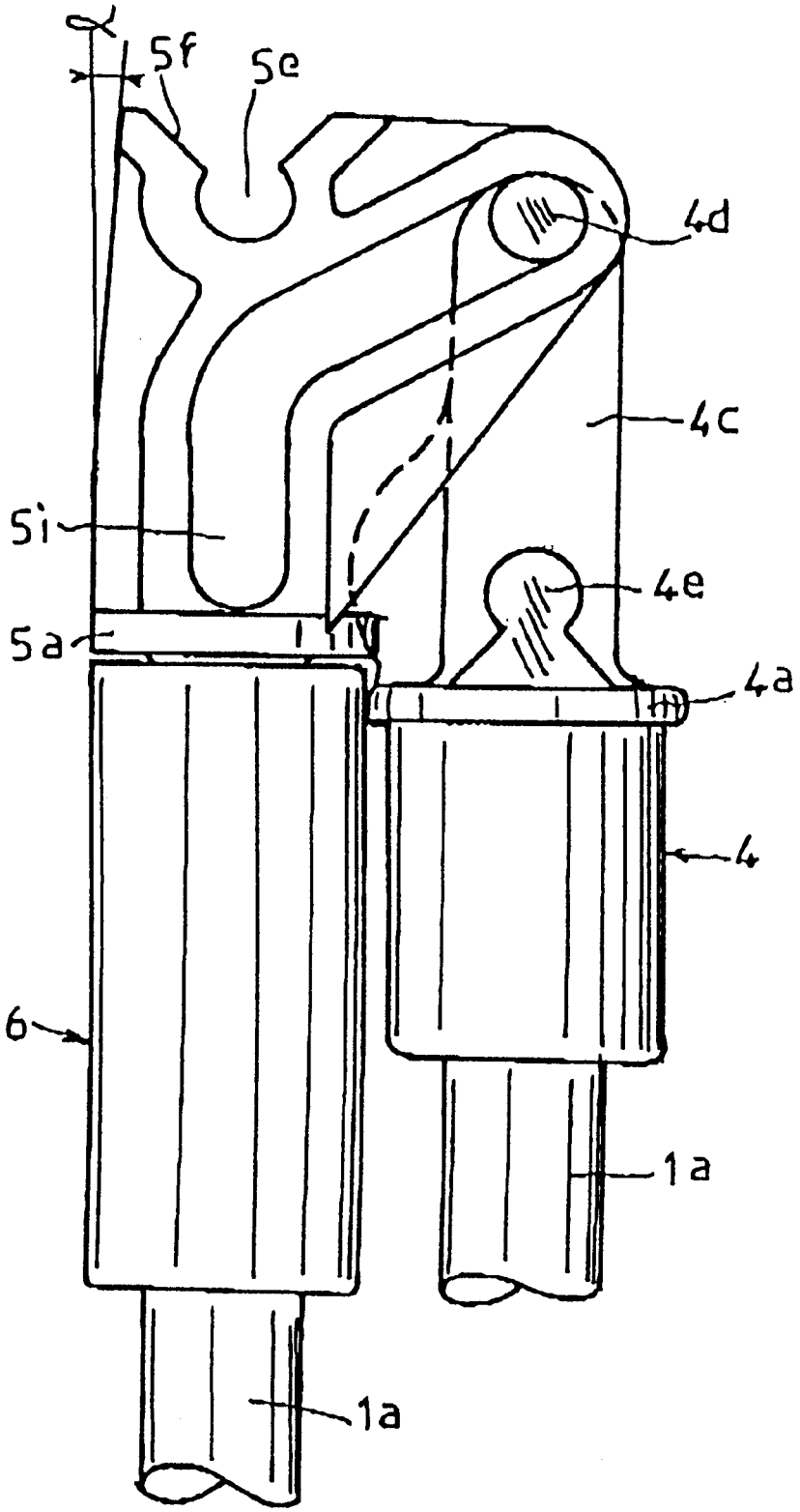
FIG. 5 is a view of the folded segments.
Figure 7:
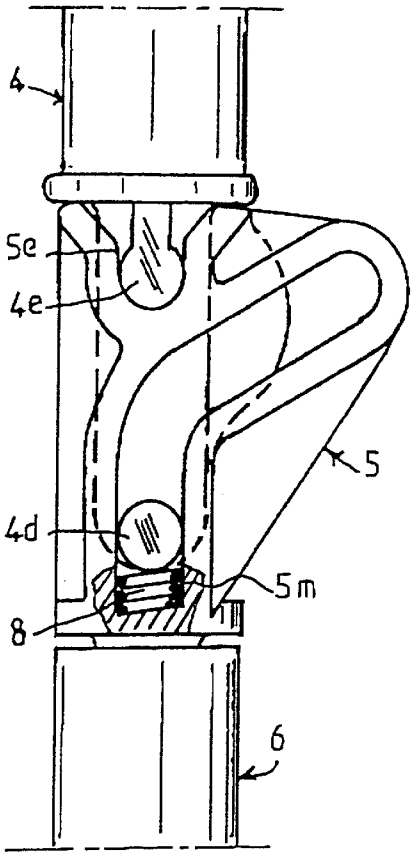
FIG. 7 is a view according to FIG. 6 in a position after installation.

Thus, referring to the drawings and especially to FIGS. 3, 4, and 5, the connector device is used in the following way:

In the initial phase, the first component (4) is introduced by its arm (4*c*) and its fingers (4*d*) before the interval formed between the cheeks of the second component (5) so as to be able to slide through the aforementioned ports. The configuration of the cheeks forming the fork is so as to constitute a knee. When this first component (4) is thus positioned, it is then folded to the bottom of the ports, i.e. toward the median zone of the second component (5) entailing then an orientation of the first component (4) in an alignment plane which is essentially axial to the other. The fingers formed on the arm near the disk forming zone then come to adjust themselves in the scallops established in the second component coming to be clipped, for example, and ensuring a locking into position. In its lower portion the second component (5) receives the pivot sleeve (6) which is kept in turn by clipping of the tabs (5*g*) in said pivot sleeve. The lower arch segment is then positioned in said pivot sleeve and one therefore obtains a fixed structure permitting the implementation of the desired arch. Several connector devices of the aforementioned type may thus be arranged for comprising the arch observing the volumetric dimensions of the tent.

Figure 6:
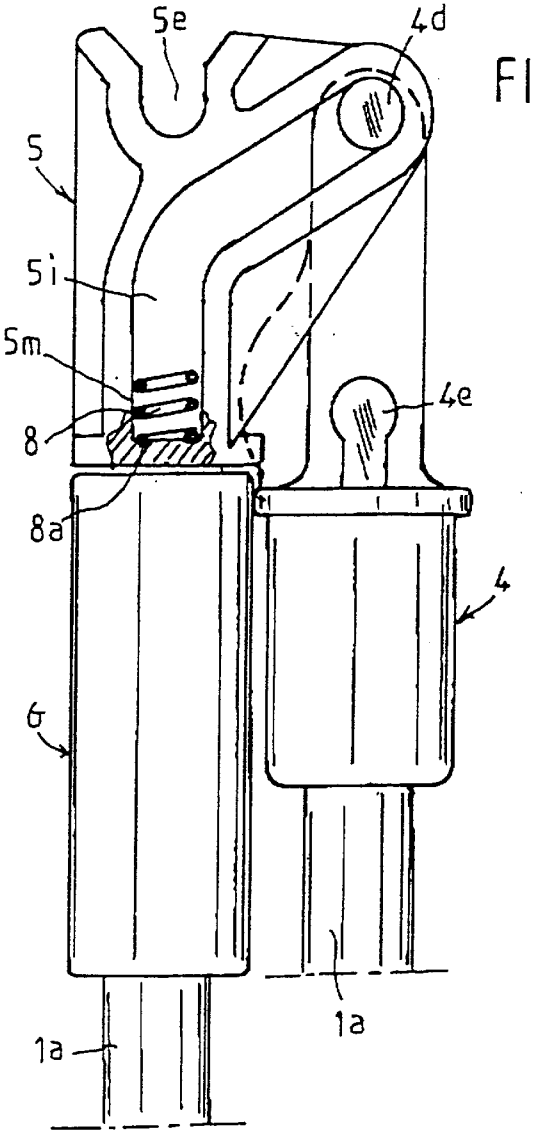
FIG. 6 is a view of a variant of the implementation according to FIG. 5 in a position before assembly.
Figure 8:
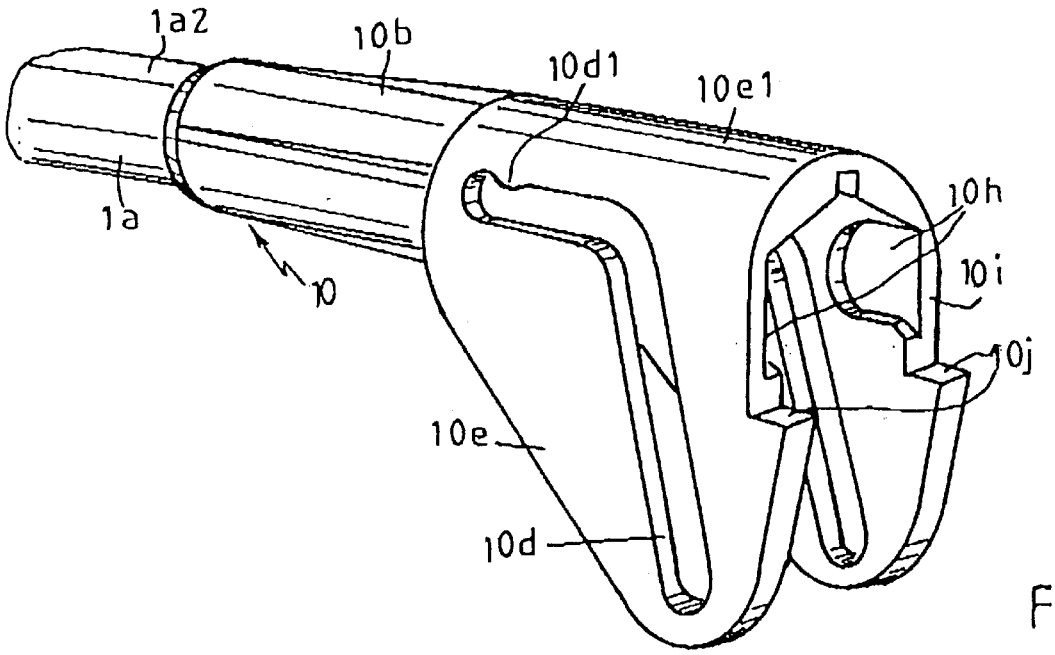
FIG. 8 is a large scale view in perspective illustrating separately the two elements of the connector device according to the invention in an implementation variant.
Figure 8:
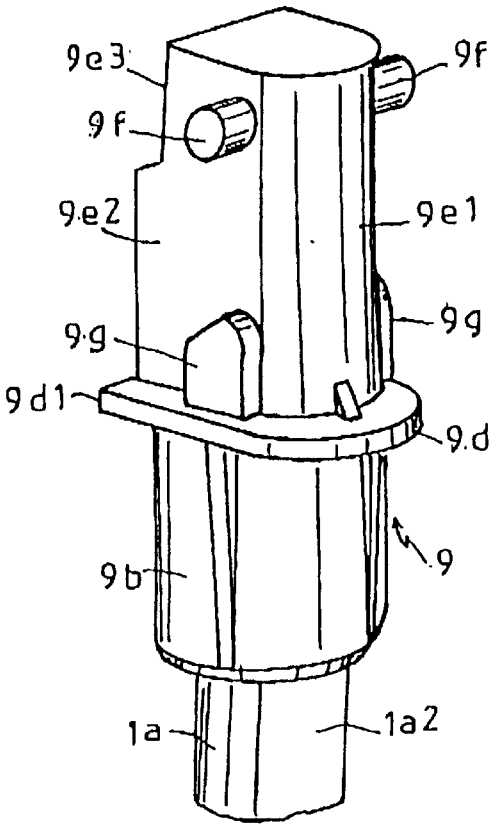
Figure 9:
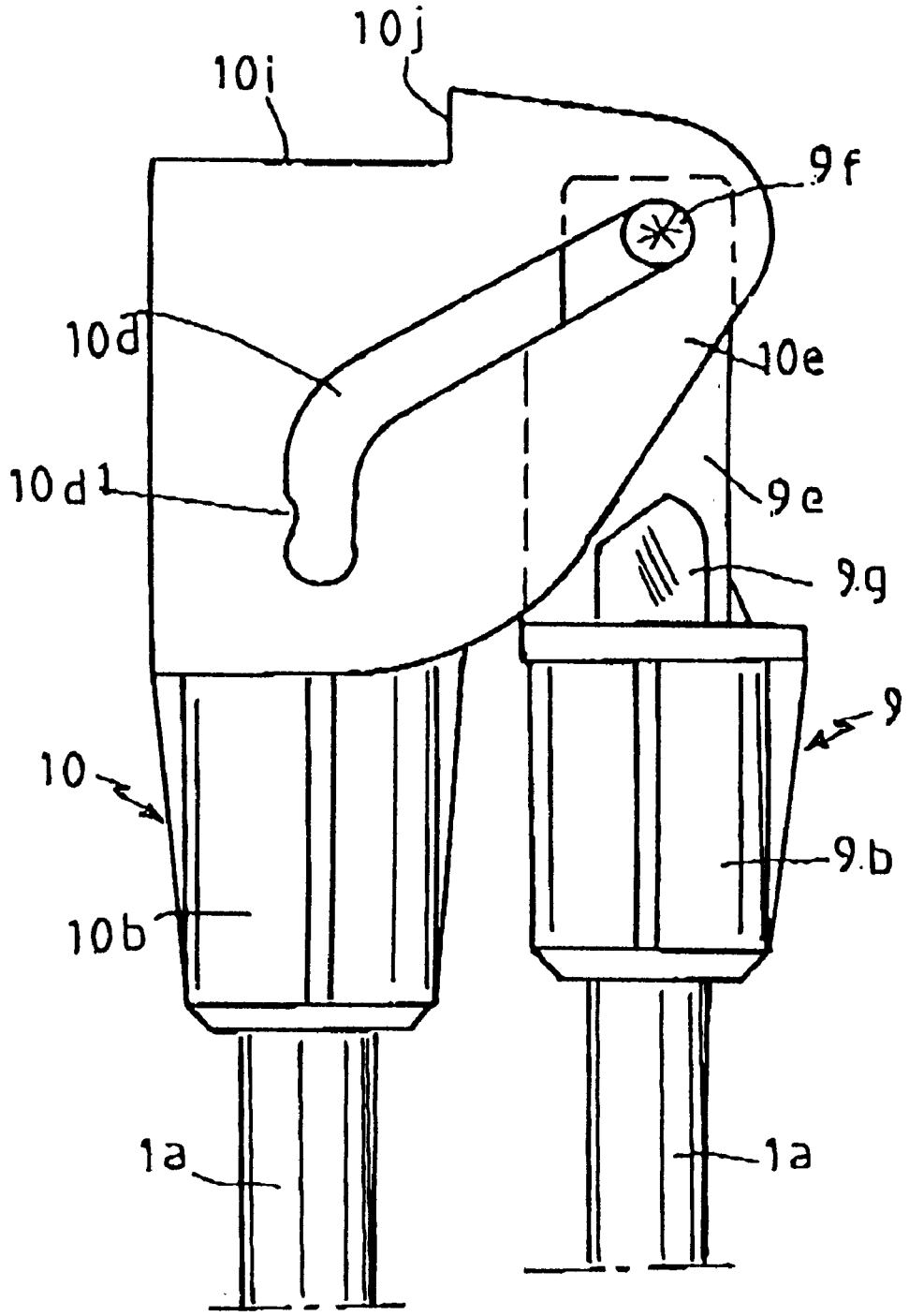
FIG. 9 is a front view illustrating the two elements of the connector in a decoupled storage position.
Figure 10:
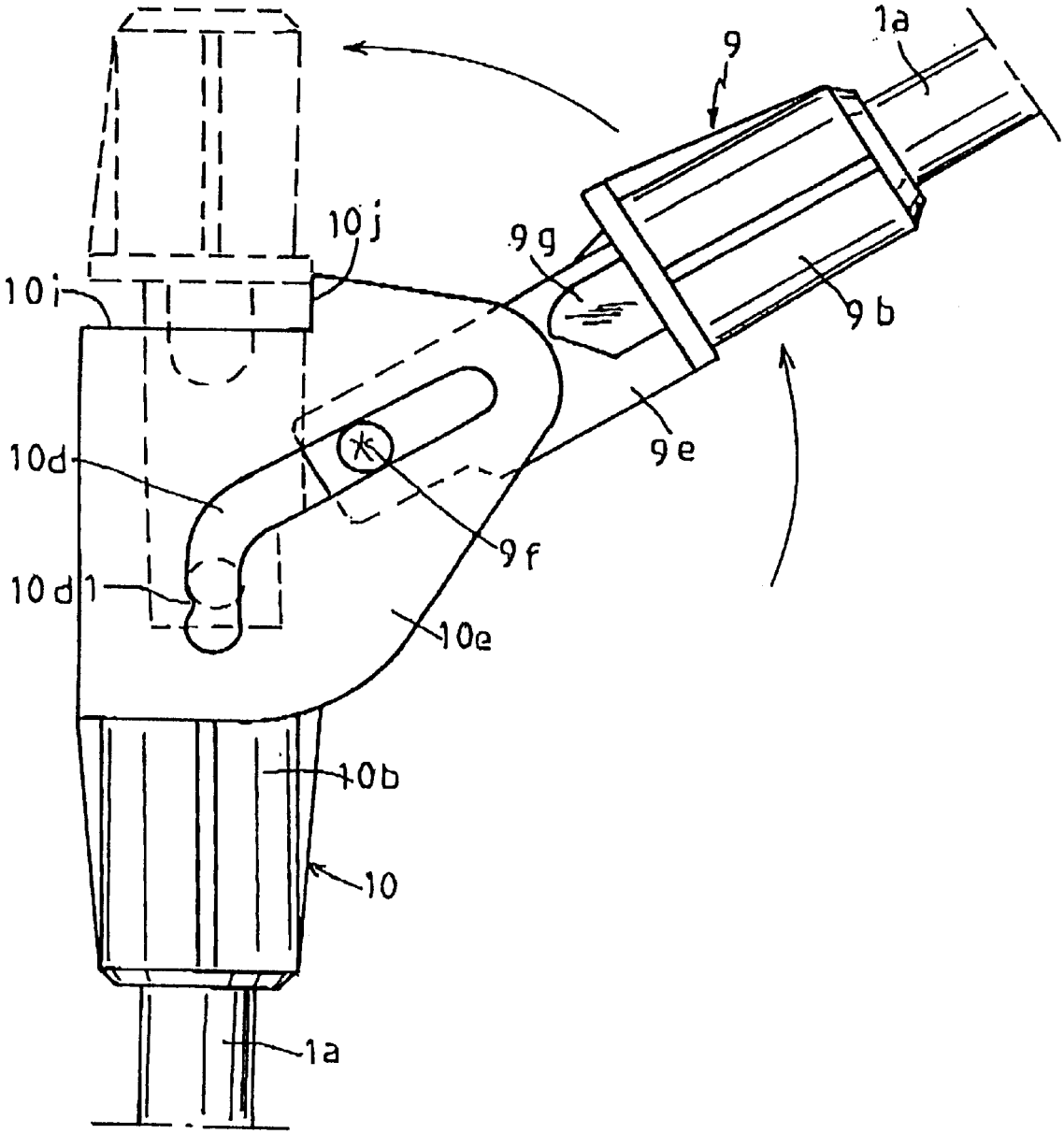
FIG. 10 is a front view illustrating the two elements of the connector during positioning.
Figure 11:
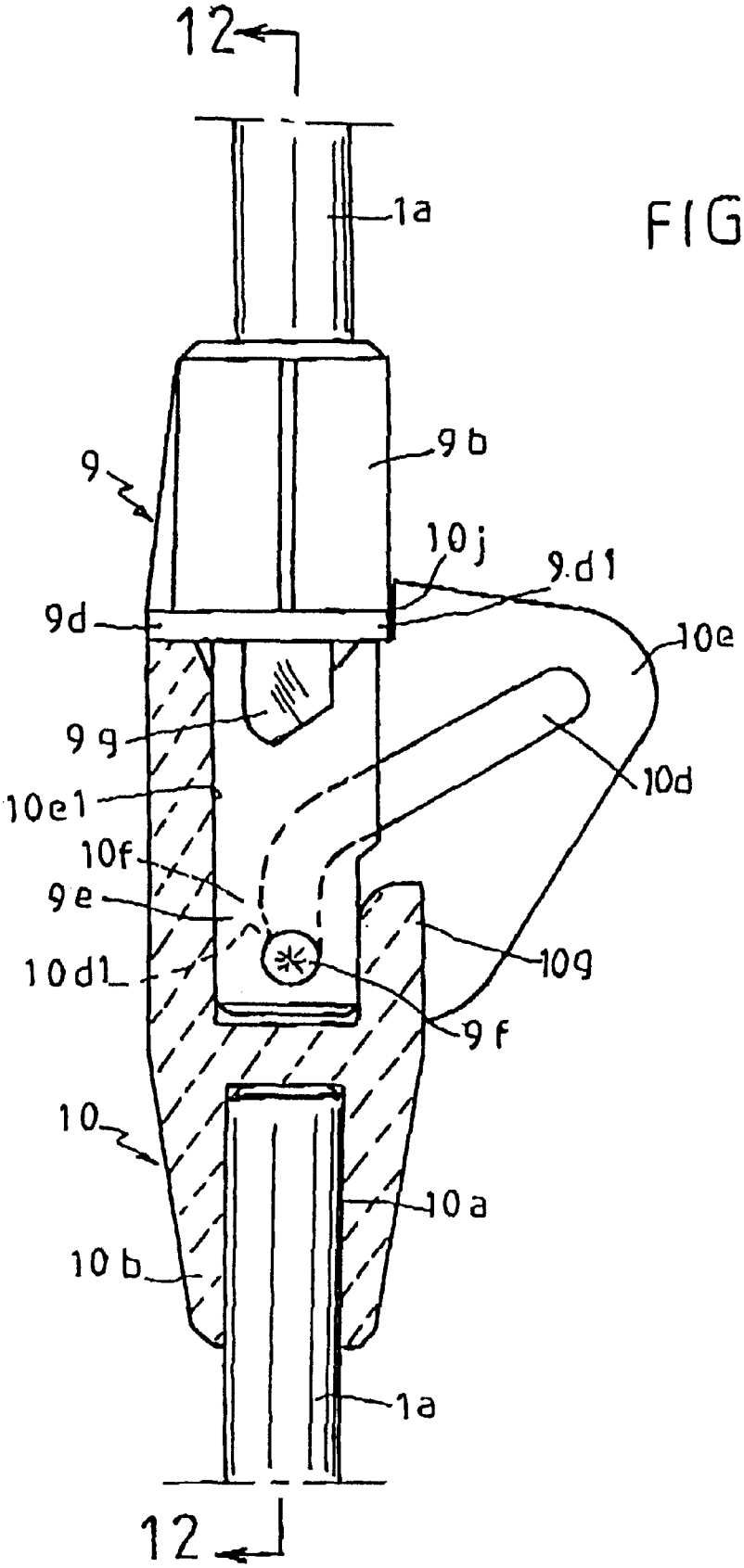
FIG. 11 is a front view with a partial cutaway illustrating the two elements of the connector in a position of assembly and of locking.
Figure 12:
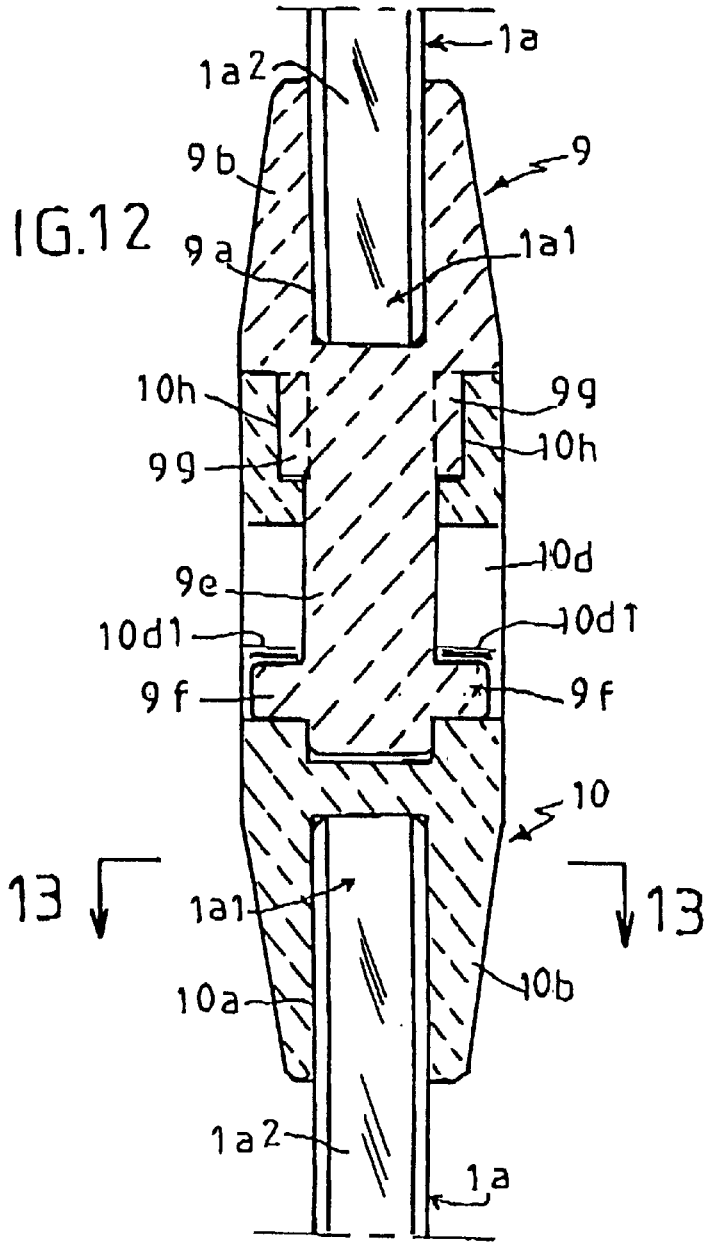
FIG. 12 is a cutaway view considered along line 12—12 of FIG. 11 showing the guiding of the two elements into a locking position.
Figure 13:
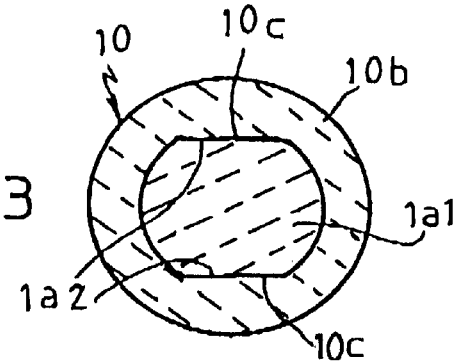
FIG. 13 is a cutaway view considered along the line 13—13 of FIG. 12, illustrating the particular profile in a cross section of the segments and of their housing in the connector elements.

In the case of disassembly, it suffices to the operator to provide the unlocking of the first component of the first segment so as to cause to pivot the second component in the manner of a knee to permit a juxtaposition in parallel and jointly of the arch segments as represented for example in FIG. 6.

Without going beyond the framework of the invention, the assembly of the first component (4) onto the second component (5) can be carried out in a way significantly different but equivalent, without special locking. In this case the receiving zone of the fingers of the first component is shaped in a cylindrical shape (5*m*) without forming a bottleneck. The bottom of the receiving fork of the cheeks is able to receive an elastic pull-back means (8) whose end (8*a*) is fixed or imbedded in the thickness of the median disk. In this configuration the putting in place of the first component (4) is carried out in the way described previously with its only difference being that the fingers (4*c*) come into elastic support by compressing the spring (8) while the fingers (4*e*) are inserted into the corresponding previously mentioned housing (5*m*). There is a placing under tension of the upper segment as a result of the different successive assemblies of the arch segments. During the unlocking, the removal of the upper segment permits releasing the tension of the springs from the first component which is folded under the conditions described previously.

Reference is now made to FIGS. 8 through 13 relative to another variant.

The connection between the segments (1*a*) and the elements of the connector device is carried out by tight sleeving between the end (1*a*1) of the segment and a boring (9–10) formed in a section of generally cylindrical shape (9–10) of each connector element (9–10);

In order to increase the rigidity of the arches while retaining their elastic deformation capacity, there is provided indexing in rotation of the segments relative to their housing, which is by a section profile of two parts having at least one flat surface, and preferably two opposite flat surfaces (9*c*–10*c*).

The flat surface or surfaces (9*c*–10*c*) have the purpose of increasing the resistance to torsion of the arch, and from this fact, entailing an automatic positioning of the connectors in a vertical plane. They are established parallel to the artificial axis of flexion of the segments.

The male element (9) has opposite the cylindrical span (9*b*) and beyond a median collar (9*d*), a tiered span (9*e*) whose lower end receives at two points diametrically opposed, pins (9*f*) which in relation to the oriented guide ports (10*d*) established on the wings of a fork (10*e*) constitute the knee joint permitting a 180 degree pivoting of the two elements between themselves, between an alignment position (FIG. 11) in view of the alignment of the tent with the segments, and a folded position by collapsing (FIG. 9) for the purpose of storage in a reduced size format, and this without disassembly.

The tiered span (9*e*) has a half circular cross section (9*e*1) on the portion of the bottom (10*e*1) of the fork (10*e*) of the same profile and a flat surface profile (9*e*2) of the opposite side to be engaged by its tiered end (9*e*3) in a cavity (10*f*) formed by the bottom (10*e*1) of the fork and a tab (10*g*) opposite, in order to increase the guiding capacity and thus the rigidity.

For the same purpose of increasing the rigidity and the guiding of the assembly, the male element (9) has immediately under the median collar (9*d*) two opposite and profiled projections (9*g*) advantageously of trapezoidal shape intended to work together during assembly with two cavities of complementary shape (10*h*) established on the inside walls of the fork (10*e*).

On the other hand, the collar (9*d*) has in alignment with the flat surface (9*e*2) a flat surface (9*d*1) so that in the position of assembly and of locking, the collar and the flat surface (9*d*1) being imbedded in a scallop (10*i*) of the fork comprising thus afterwards the boss surfaces (10*j*) during the bending of the segments.

Finally, the locking into position is advantageously obtained at the end of the course by preparation of the lower portion of the ports (10*d*) in the form of at least one projection (10*d*1) permitting the passage in force of the joint pins (9*f*) then their retention at the bottom of the ports.

Thus, by the combination of the locking of the pins (9*f*) in the ports, of the guiding of the flat surface cylinder segment (9*e*) in the cavity (10*f*) and of the retracted position of the flat surface (9*d*1) of the collar against the bosses (10*j*), one obtains maximum rigidity of the assembly with a girder effect of the whole.

On the other hand, the guiding of the connector elements in the sheath of the tent is improved due to the fact of the alignment of the parts and of the compact and rounded shapes of the connector elements. Finally, the assembly or the disassembly of the tent is rapid and easy.

The invention affords numerous advantages. It permits using arch segments formed of synthetic material of the fiberglass type without being subject to the fragility of the latter. The segments may be of other structural materials such as aluminum, where applicable.

The invention permits obtaining:

A very rapid assembly of the arches of the tent with a gain of lightness according to the type of structural materials used for the segments.

A resistance to crushing and to folding [which is] greater according to the type of segment structural materials used.

Very easy replacement of broken elements (connectors or segments).

The connector device offers other advantages. Considering the arch segments positioned in folding up the tent, the automatic encasing of the various segments into the aforementioned connector device permits, with an appropriate tension, the takedown of the tent. The elimination of the tension on the arch segments causes the automatic desocketing of said segments in folding thus permitting the overall rapid folding up of the tent avoiding the manual operation of disassembly of the tubes.

What is claimed is:

1. A connector device for joining upper and lower pole segments of a tent, comprising:

male and female components coupled to one another so as to be configured in the form of a knee to permit positioning of said components in a vertical plane or in an extension corresponding to the shape of the tent, both allowing the upper and lower pole segments to be placed in tension, or in a folded position where the upper and lower pole segments are folded in an adjacent and substantially parallel manner, said male component comprising a first end portion for attachment to an end of one of the upper and lower pole segments, and an opposed second end portion in the shape of an elongate member having joint pins for connecting said male component to said female component said elongate member having at least one projection profiled therein, said female component comprising a first end portion for attachment to the other one of said upper and lower pole segments, and an opposed second end portion including two spaced, substantially parallel members, each said member having a V slot formed therethrough defining oriented ports, wherein said joint pins are received within said ports to permit displacement and pivoting up to 180° of said male component relative to said female component, said female component further comprising at least one complementary cavity, said cavity capable of accepting said projection;

wherein said components can be locked in an alignment position by placing said joint pins into a bottom section of said ports.

2. The connector device of claim 1, wherein said male component has, substantially at its median portion, a disk member separating said first end portion from said second end portion, said first end portion having a hollow tubular part for receiving an end of one of the upper and lower pole segments, and said joint pins include two lower fingers that engage the V slot in said female component and two upper fingers adjacent said disk to ensure articulation of said male component on said female component and the locking of said male and female components together.

3. The connector device of claim 2, wherein said female component includes a central disk separating said first end portion from said second end portion, said first end portion having means for pivotally receiving an end of the other one of the upper and lower pole segments, said two members of said second end portion of said female component being profiled to permit guiding, folding, and positioning of the said elongate member of said male component, said two members of said second end portion of said female component being tiered with a housing to permit positioning and locking of the upper fingers of said male component.

4. The connector device of claim 3, wherein the base of said two members of said second end portion of said female component are situated in the longitudinal axial extension of said component or at an angle of 2 to 5 degrees with respect to said component, and further include means for receiving said upper fingers of said male component.

5. The connector device of claim 3, further comprising spring means positioned in the bottom of the V slot formed in said female component, wherein the surfaces of the V slot are smooth to permit the upper pole segment to be placed in tension.

6. The connector device of claim 3, wherein said female component further comprises a pivot sleeve that allows free pivoting of the upper and lower pole segments relative to one another, said pivot sleeve including a collar having an annular groove formed therein for receiving tabs extending from the first end portion of said female component, said collar further including an opening distal from said annular groove for receiving an end of the lower pole segment.

7. The connector device of claim 3, wherein a lower portion of said elongated member of said male component has a downwardly extended protrusion for preventing blockage of said male and female components when articulated relative to one another from said folded position to an extended position.

8. The connection of claim 1 that further include at least one projection profiled and opposed in the median position, and the other of the complementary cavities established in the inside walls of the fork bearing the oriented ports for the purpose of guiding and aligning the male and female components, wherein the locking of the components in an alignment position is carried out at the end of the course by clipping the joint pins in the ports and the male and female components are connected to the pole segments with angular indexing.

9. The connector device of claim 8, wherein the angular connection between the pole segments and the connector components is carried out by tight sleeving between an end of the pole segment having at least one flat surface in cross section, and a bore in the connector components having likewise at least one flat surface, whereby the flat surfaces increase resistance to torsion of the pole, and automatically position the connector components in a vertical plane, such that they are established parallel to the artificial axis of flexion of the segments.

10. The connector device of claim 8, wherein the locking by clipping of the connector components is carried out by at least one projection in the lower portion of the oriented ports permitting the forcible passage of the joint pins and subsequent retention at the bottom of the ports.

11. The connector device of claim 8, wherein the male component has opposite a cylindrical section, a tiered section of half circular cross section of the bottom side of the fork and a flat surface profile of the opposite side to be engaged by its tiered end in a cavity formed by the bottom of the fork and a tab at the opposite end.

12. The connector device of claim 1 further comprising:

an end of the pole segment having at least one first flat surface in cross section;

one of said connector components having at least one second flat surface; and, a tight sleeving that forms an angular connection between the pole segments, whereby said first flat surface and said second flat surface increase resistance to torsion of the pole, and automatically position the connector components in a vertical plane such that the flat surfaces are established parallel to an artificial axis of flexion of the segments.

* * * * *